US010144140B2

(12) United States Patent
Landwehr

(10) Patent No.: US 10,144,140 B2
(45) Date of Patent: Dec. 4, 2018

(54) CUTTING HAND TOOL

(71) Applicant: Thomas Jay Landwehr, DePere, WI (US)

(72) Inventor: Thomas Jay Landwehr, DePere, WI (US)

(73) Assignee: Ritesafety Products Internatioal, LLC, De Pere, WI (US)

( * ) Notice: Subject to any disclaimer, the term of this patent is extended or adjusted under 35 U.S.C. 154(b) by 67 days.

(21) Appl. No.: 15/475,288

(22) Filed: Mar. 31, 2017

(65) Prior Publication Data

US 2018/0281210 A1 Oct. 4, 2018

(51) Int. Cl.

| | |
|---|---|
| ***B26B 5/00*** | (2006.01) |
| ***B26B 27/00*** | (2006.01) |
| *B26B 1/08* | (2006.01) |

(52) U.S. Cl.

CPC ..... *B26B 5/003* (2013.01); *B26B 5/00* (2013.01); *B26B 5/001* (2013.01); *B26B 27/005* (2013.01); *B26B 1/08* (2013.01)

(58) Field of Classification Search

CPC ..... B26B 5/003; B26B 5/00; B26B 27/005; B26B 5/001; B26B 1/08

See application file for complete search history.

(56) References Cited

U.S. PATENT DOCUMENTS

| | | | | |
|---|---|---|---|---|
| 6,233,830 | B1 * | 5/2001 | Lamond | B26B 5/001 30/123 |
| 6,807,738 | B1 * | 10/2004 | Shih | B26B 1/04 16/111.1 |
| 6,865,816 | B1 * | 3/2005 | Zajdel | B26B 5/00 30/162 |
| 7,380,341 | B2 * | 6/2008 | Ping | B26B 1/042 30/155 |
| 8,006,389 | B2 * | 8/2011 | Jennings | B26B 5/003 30/155 |
| 2004/0226175 | A1 * | 11/2004 | Ping | B26B 1/042 30/340 |
| 2005/0278955 | A1 * | 12/2005 | Lee | B26B 1/02 30/153 |
| 2008/0289191 | A1 * | 11/2008 | LeBlanc | B26B 1/042 30/160 |
| 2011/0271531 | A1 * | 11/2011 | Huang | B26B 5/00 30/162 |
| 2011/0308094 | A1 * | 12/2011 | Wu | B26B 5/00 30/333 |
| 2012/0272529 | A1 * | 11/2012 | Constantine | B26B 1/08 30/162 |
| 2014/0373364 | A1 * | 12/2014 | Li | B26B 1/046 30/152 |
| 2016/0046026 | A1 * | 2/2016 | Ranieri | B26B 5/001 30/123 |
| 2016/0311121 | A1 * | 10/2016 | Wang | B26B 5/00 |
| 2016/0311123 | A1 * | 10/2016 | Schoon | B26B 27/007 |

* cited by examiner

*Primary Examiner* — Sean Michalski

(57) ABSTRACT

A cutting hand tool with a blade slide and a lower front part of the housing that pivots down providing access to blade securing means if the blade slide is in the extended position with additional pivoting blade securing means connected to the blade slide providing access to the blade for replacement in the horizontal open position.

4 Claims, 10 Drawing Sheets

CUTTING HAND TOOL

FIELD OF THE INVENTION

The present invention relates to a cutting hand tool with a means for replacing a slidable blade mounted within a housing.

BACKGROUND OF THE INVENTION

New developments, in particular in the field of security for the prevention of injuries, have made cutting hand tools more sophisticated, more complex to produce and therefore more expensive. Such cutting hand tools represent a true investment for companies and as a result, they should be made to last. While the sustainability of these tools is being constantly improved, the lifetime of a blade may not exceed a few days or even only hours in the context of intensive industrial use until its cutting edge becomes unsuitably dull. Moreover, the sharper the blade, the easier it can become damaged. Accordingly, blade replacement means have become standard features for many cutting hand tools on the market. Yet, if changing a blade is fairly straightforward on a regular cutting hand tool with a fixed blade, it is more challenging in the case of a blade slidably mounted into the housing.

In practice, blade replacement methods differ according to the position of the blade during the exchange: the blade may be replaced either in the rear position, when it is completely retracted into the housing, or in various front positions, when it partially protrudes out of the housing.

U.S. Pat. No. 8,375,588 and US 2013/0091712 show examples of cutting hand tools with a slidable and exchangeable blade, where the blade is replaced in its rear position. However, having to open the whole housing every time the blade needs changing is tedious. In addition, this exposes the inner components of the knife and may have several unwanted consequences. First, some component may fall out by inadvertence. Then, dirt, wood chips, sand, or grease may land thereon from the worker's hands or from the workplace environment, which would seriously compromise the proper functioning of the cutting hand tool, especially if it contains moving parts. Besides, no inner component can be anchored on any detachable part of the housing, for this part has to be able to move freely when opening the housing. So, all the inner components of such knives may end up being fixed to one region of the housing only.

More recent inventions relate to cutting hand tools where the blades can be replaced in the front position, thus avoiding the need of opening the complete housing for the replacement. However, the blade is never fully pushed out and its securing means remains concealed within the housing. So, the lack of a direct view of the way the blade interlocks with the securing means makes the replacement of the blade trickier. AU 2011201623 discloses a knife with a sliding blade which can be replaced in the front position, the blade being biased towards the rear position with a spring. So, in order to prevent the blade from sliding back into the housing during the replacement, it can be locked in the front position. This defeats the purpose of biasing it towards the rear position, which is meant to protect the blade automatically when the tool isn't being used. If it is possible to lock the blade in the unsheathed position, the worker will choose to do so and leave the blade permanently unsheathed for convenience. As a result, he is likely to get injured in a moment of inattention. Alternatively, AU 2011201624, U.S. Pat. No. 8,769,826 and US 2014/317936 disclose similar cutting hand tools whose blades cannot be locked into the front position but require the user to keep pushing on a slider during the replacement. However, this is tiring and prevents the user from using his two hands for replacing the blade, which makes the operation trickier.

SUMMARY OF THE INVENTION

A first object of the present invention is to provide a cutting hand tool with a slidable blade, which can easily be replaced in the forward unsheathed position by having direct access to the blade securing means without having to open the whole housing.

A second object of the present invention is to provide a cutting hand tool with a blade slide biased towards the rear position, but which is automatically locked into the front position when changing the blade. For the security of the user, the cutting hand tool is not usable in this configuration, and the blade slide is unlocked as soon as the new blade is secured on it.

DETAILED DESCRIPTION OF THE INVENTION

Figure 1:
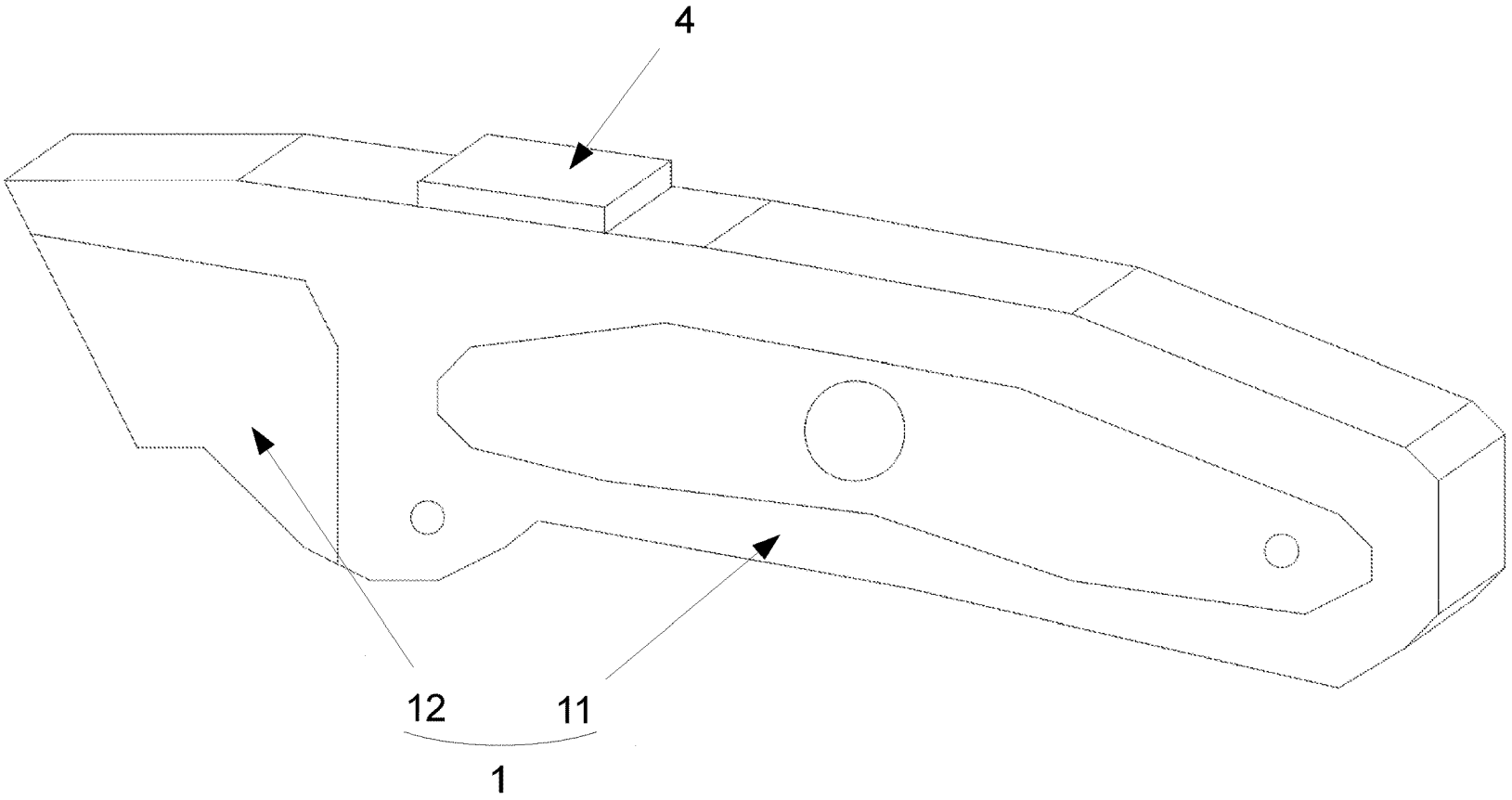
FIG. 1 Perspective view of the cutting hand tool, lower front part of the housing in closed position FIG. 2 Perspective interior view of the cutting hand tool FIG. 3*a* Perspective view of the cutting hand tool, blade slide in front position FIG. 3*b* Perspective view of the cutting hand tool, blade slide in front position, lower front part of housing open FIG. 3*c* Perspective view of the cutting hand tool, blade slide in front position, lower front part of housing open, blade securing means open FIG. 4*a* Perspective view of the cutting hand tool, lower front part of housing open FIG. 4*b* Perspective view of the cutting hand tool, lower front part of housing open, blade slide in front position FIG. 4*c* Perspective view of the cutting hand tool, lower front part of housing open, blade slide in front position, blade securing means pivoted into the horizontal position FIG. 4*d* Perspective view of the cutting hand tool, lower front part of housing open, blade slide in front position, blade securing means pivoted back into the vertical position after blade exchange FIG. 4*e* Perspective view of the cutting hand tool, lower front part of housing open, blade slide in retracted position after releasing the actuator button
Figure 2:
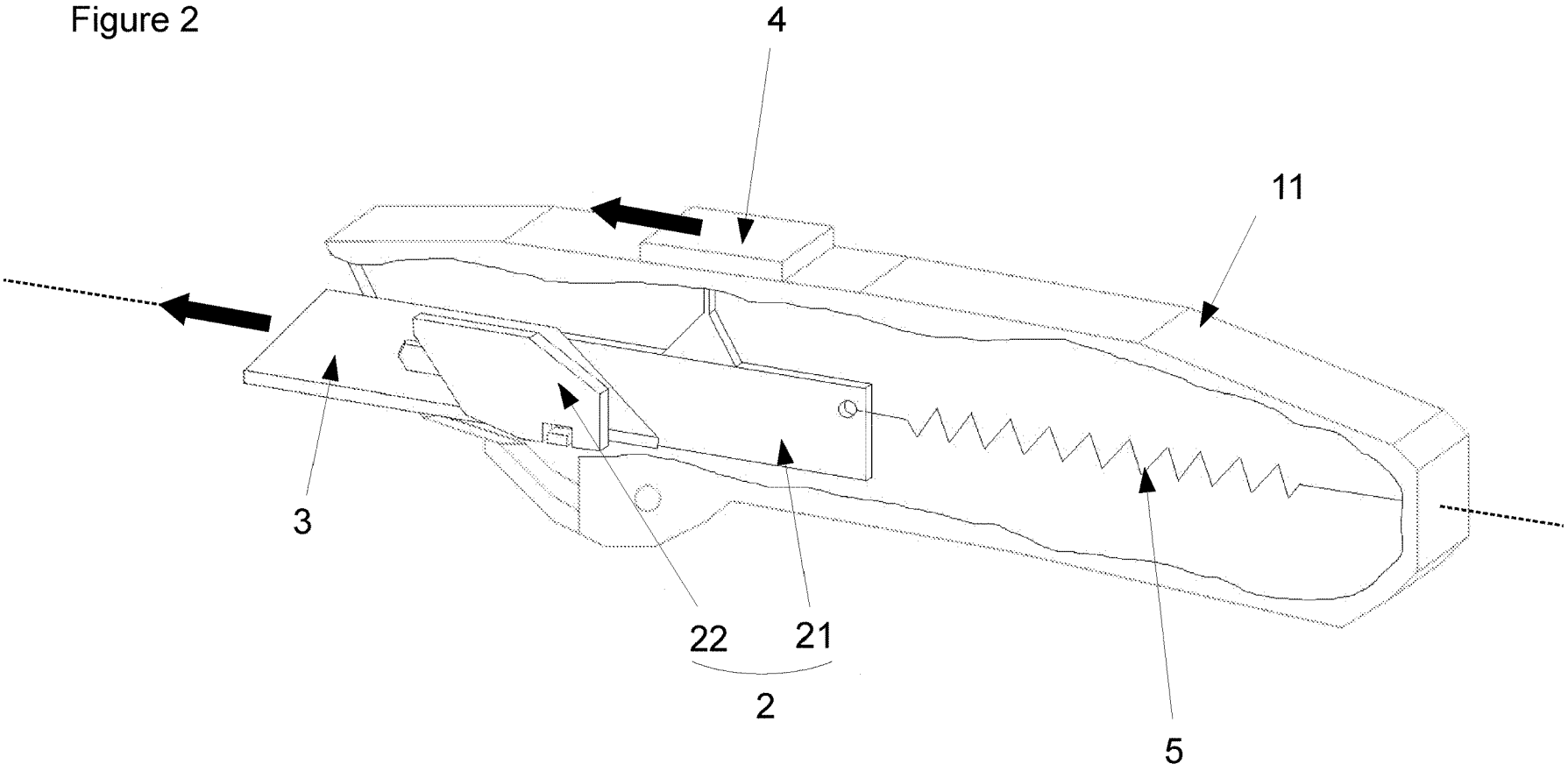

The housing 1 of the cutting hand tool has a handle-like shape suitable for gripping with a hand and defining a longitudinal direction (FIGS. 1 and 2). The housing 1 contains a blade 3 removably fixed to a blade holder 21 with the blade securing means 22 (FIG. 2). The blade holder 21 and the blade securing means 22 form a blade slide 2 which slide back and forth within the housing along the longitudinal direction, for example by operating the slider 4 arranged outside of the housing. The blade slide 2 has two main positions: a fully extended front position and a fully retracted rear position. In the front position (FIG. 2), the blade 3 partially protrudes out of the front part of the cutting hand tool: this is the operating position where the cutting hand tool is ready for cutting. In the rear position, the blade 3 is fully retracted into the housing: this is the storage position where the housing 1 protects the user from any contact with the blade 3, thus preventing injuries.

Figure 3A:
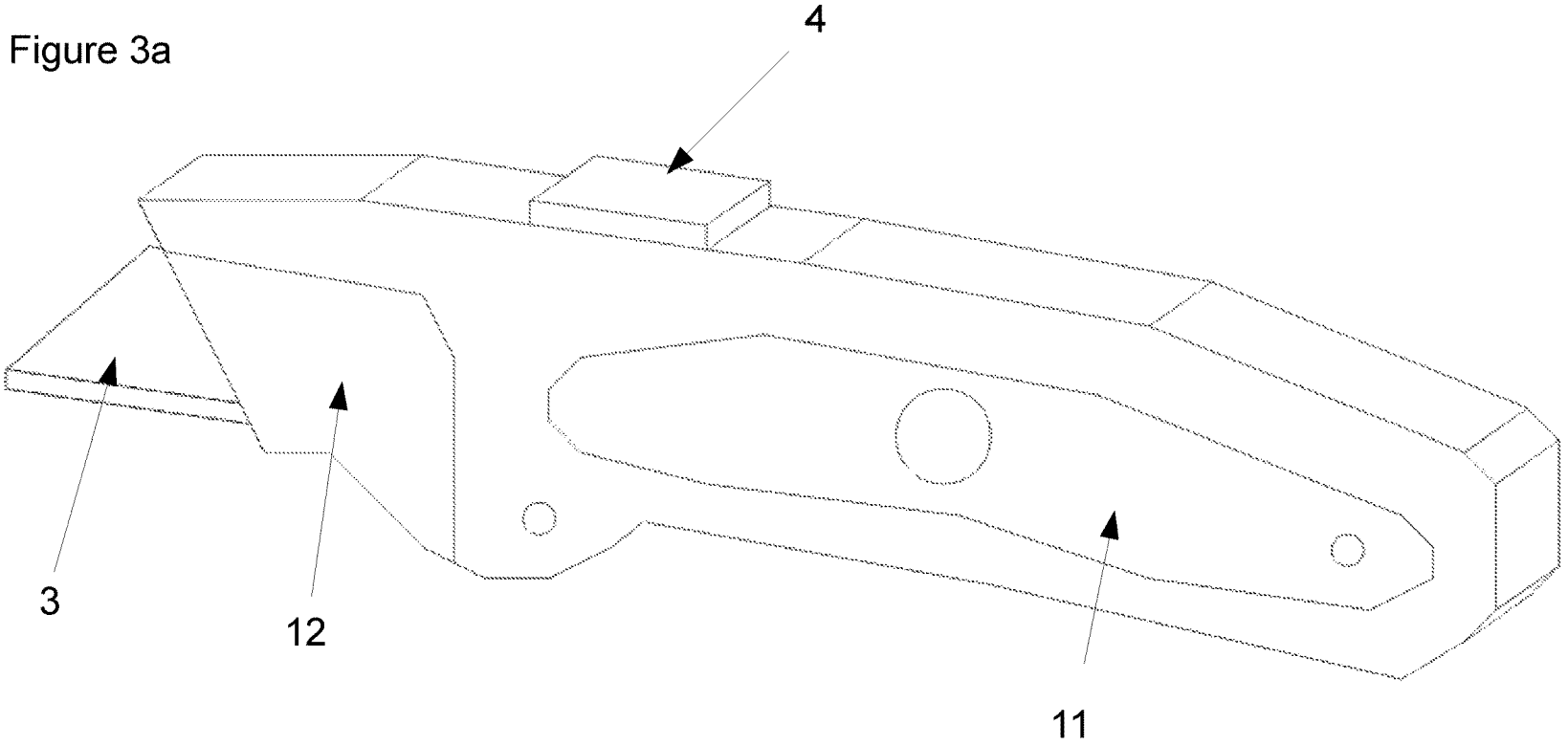

When the cutting edge of the blade 3 becomes unsuitably blunt, the blade 3 needs to be replaced. Neither the front position or the rear position of the blade slide provide access to the blade for an easy blade replacement. In order to replace the blade 3 in the rear position the complete housing 1 or at least a considerable part of the center of the housing would need to be opened to be able to access the blade 3. In the front position (FIG. 3*a*), the blade 3 partially protrudes out of the front face of the housing 1. Therefore the blade would need to be extended further to provide full access to the blade to be replaced.

Figure 3B:
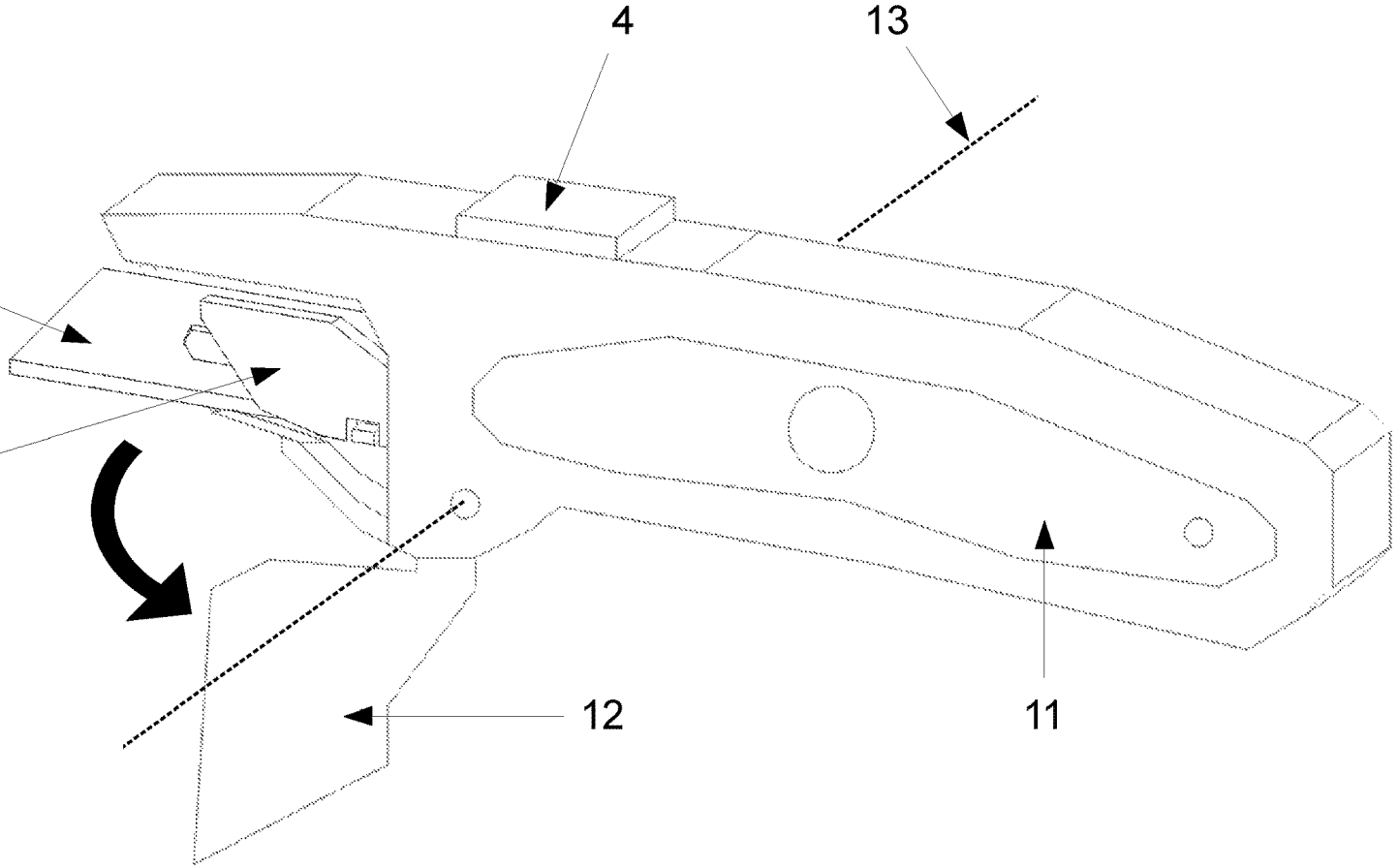

In the preferred embodiment of the current invention the housing 1 comprises a movable lower front part located in the vicinity of the blade 3. This lower front part 12 is pivotally connected to the main part 11 of the housing 1 and pivots around an axis 13 perpendicular to the longitudinal direction. When the blade 3 is in the front position (FIG. 3*a*), pivoting the lower front part 12 of the housing 1 downwards provides direct access to the blade securing means 22 (FIG. 3*b*). In this way only a limited part 12 of the housing 1 needs to be opened, to expose the relevant parts for changing the blade, while keeping the rest of the inner components carefully protected inside the housing 1.

Figure 3C:
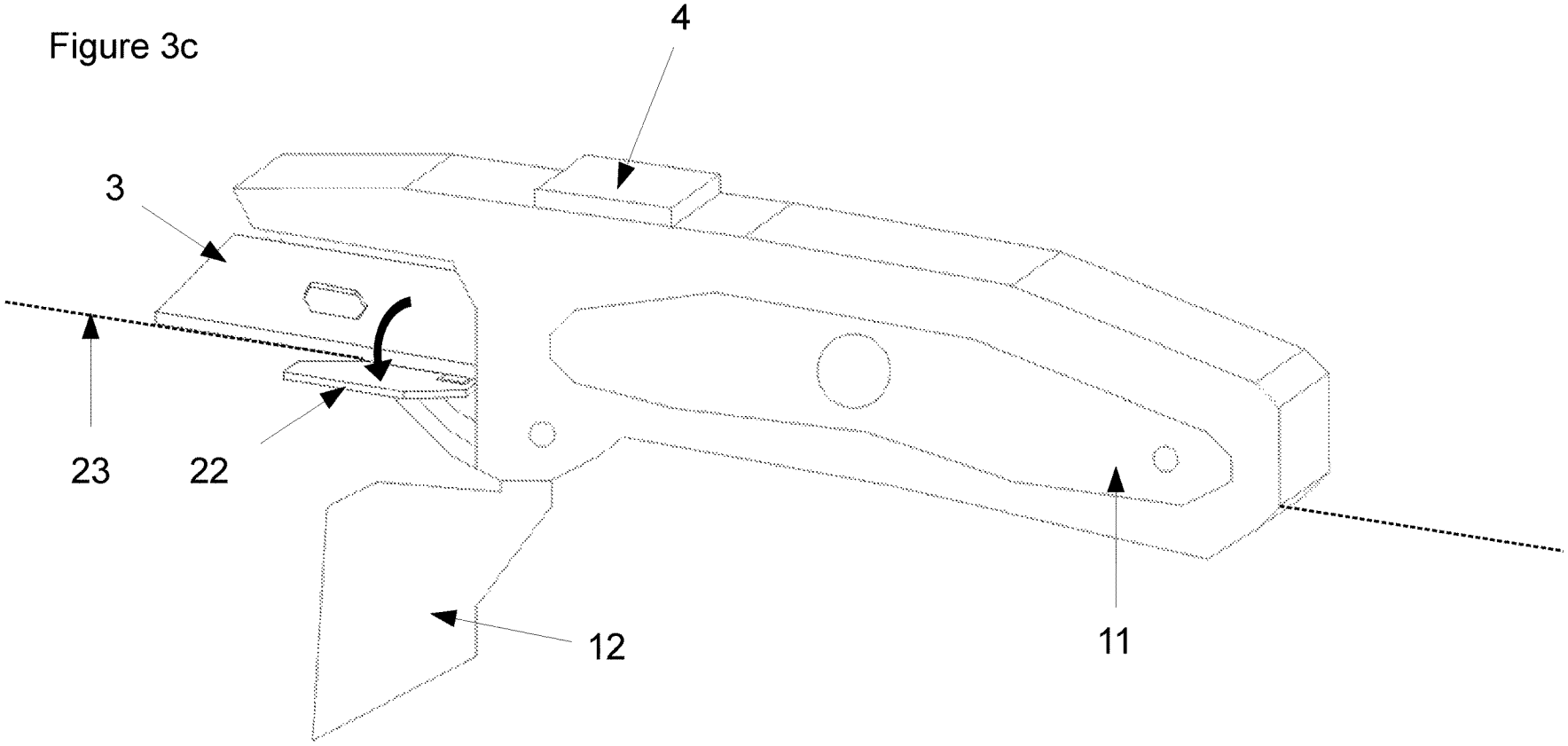

Once the blade 3 and the blade slide 2 are partially exposed, the user can easily remove the blade securing means 22 and release the blade 3. The blade is secured by clamping between the two substantially vertical faces of the blade holder 21 and the blade securing means 22. This blade securing means 22 is pivotally connected to the blade holder and pivots around an axis 23 parallel to the longitudinal direction. So, when the blade securing means 22 is pivoted away from the blade holder 21 downward to a substantially horizontal position, the blade 3 is released and can be removed and replaced with a new blade (FIG. 3*c*). In order to prevent the blade 3 from falling out as soon as the blade securing means 22 is pivoted away, the blade holder 21 may feature one or several nubs which interlock with corresponding notches or apertures in the blade 3. Additionally, the blade holder 21 may feature magnets which maintain the blade in place even when the blade securing means 22 is open. Such magnets may also be used to guide and hold the new blade 3 into the proper position prior to closing the securing means 22, thus making the blade replacement safer, quicker and easier.

For security reasons, the blade slide 2 may be biased towards the rear position, in order to retract the blade 3 automatically into the housing 1 when the cutting hand tool isn't being used or with an automated retraction mechanism which retracts the blade immediately after it has been cut. Springs, magnets or various other means may be used as biasing means 5. In the context of the current invention if the blade slide 2 isn't temporarily locked in the front position during the blade replacement, the user has to keep pushing on the slider 4 to counter the rearwards bias. As a result, the user is left with only one free hand for opening the blade securing means 22, removing the old blade 3, inserting the new blade and closing the blade securing means 22 again. The danger of dropping the blade or accidentally releasing the slider 4 leading to the retraction of the blade 3 during the replacement may cause injuries.

In a preferred embodiment of the cutting hand tool, the shape of the blade securing means 22 is specially adapted for temporarily locking the blade slide 2 in the front position while the blade 3 is being replaced. The blade securing means 22 is substantially flat and arranged vertically parallel to the lateral faces of the blade 3. In this position, it can slide freely in and out of the housing 1. As soon as the blade securing means 22 is pivoted downward into a substantially horizontal position, its rear end, abuts with the lateral face of the main part 11 of the housing 1 and prevents the blade slide from sliding backwards. In this position, the blade securing means 22 rests on the main part of the housing 1 and temporarily locks the blade slide 2 in the front position allowing the user to use both hand for replacing the blade. As soon as the blade securing means 22 is pivoted back into its vertical position, simultaneously securing the new blade 3, the temporary lock is removed and the blade slide 2 is retracted.

Figure 4A:
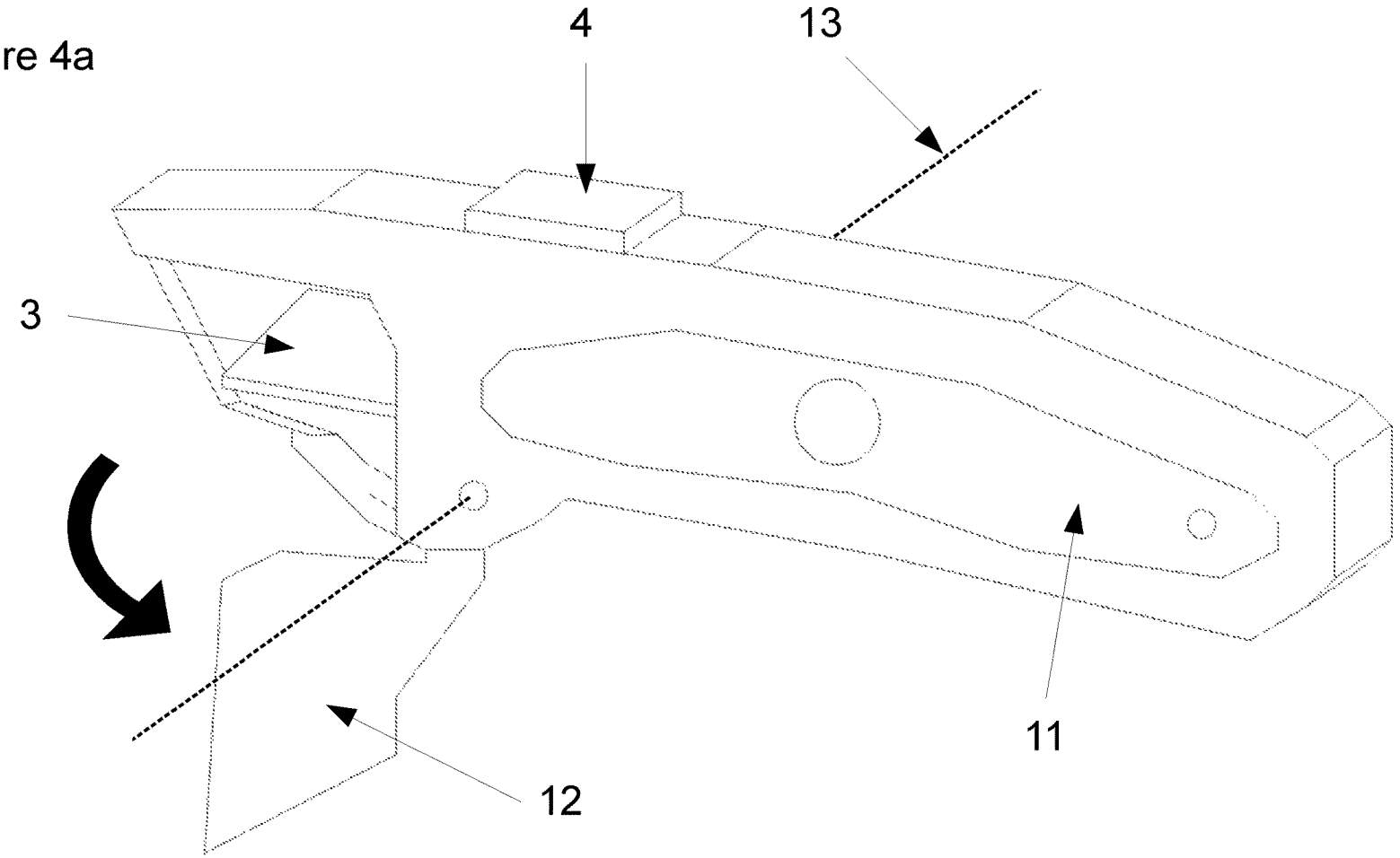
Figure 4B:
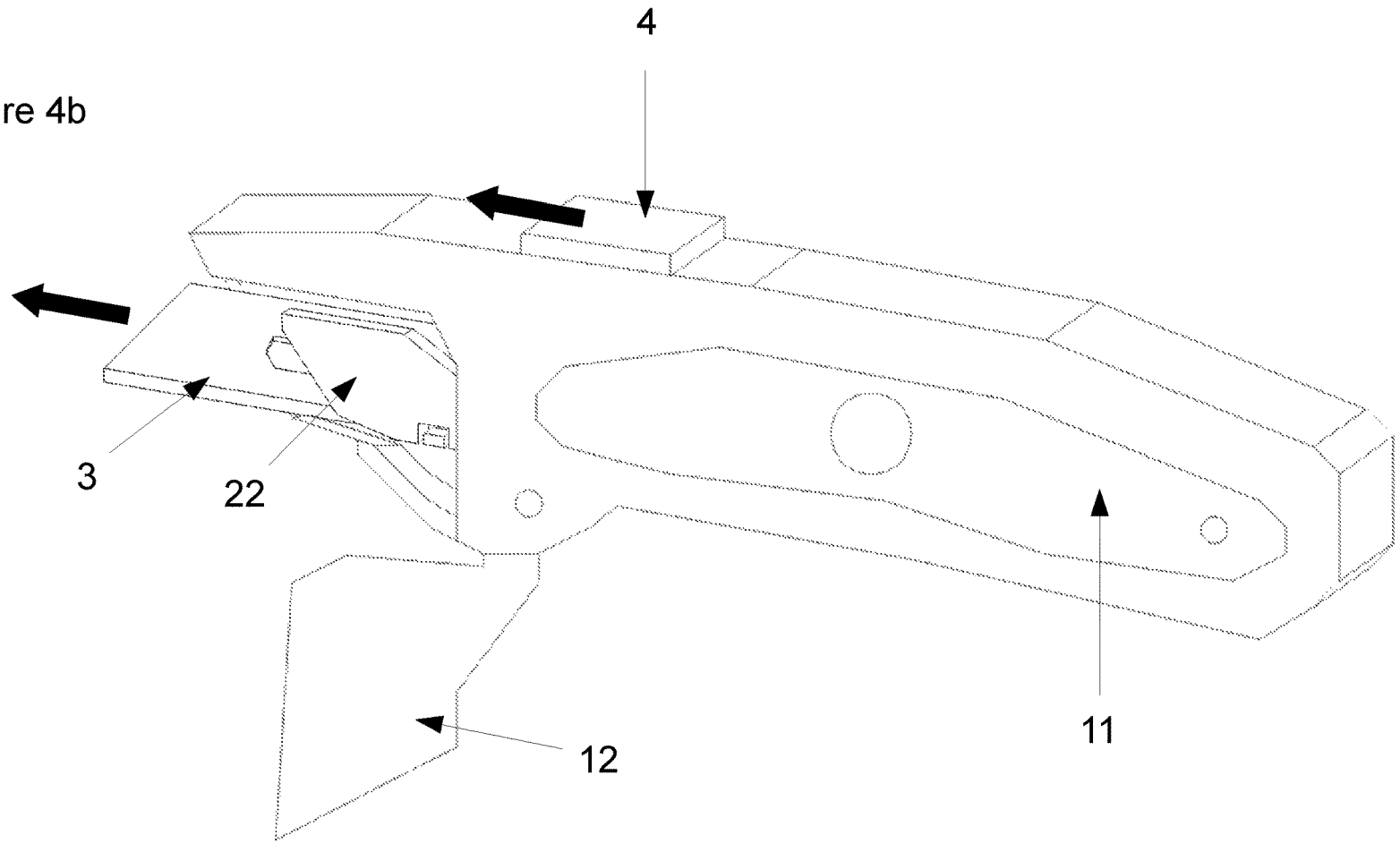
Figure 4C:
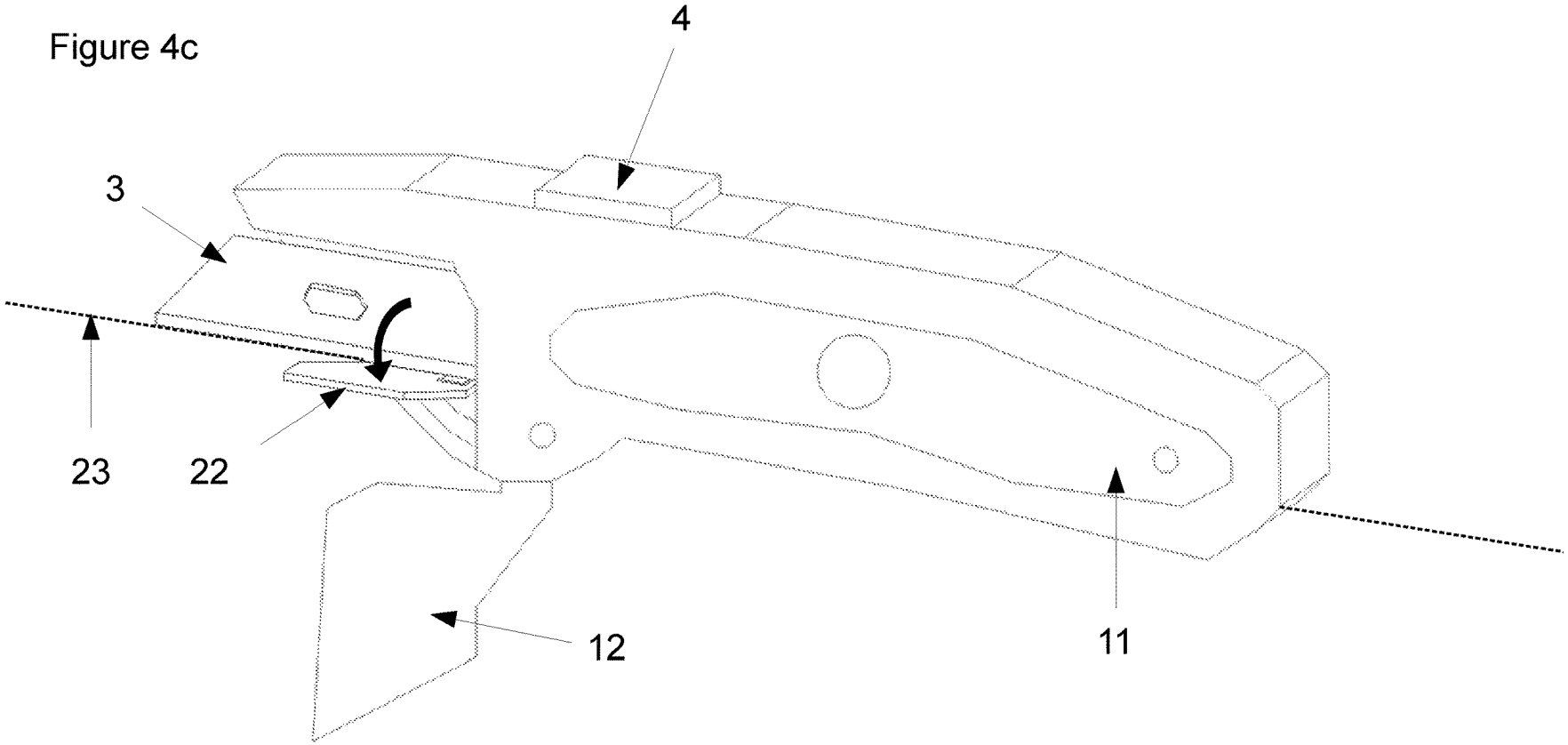
Figure 4D:
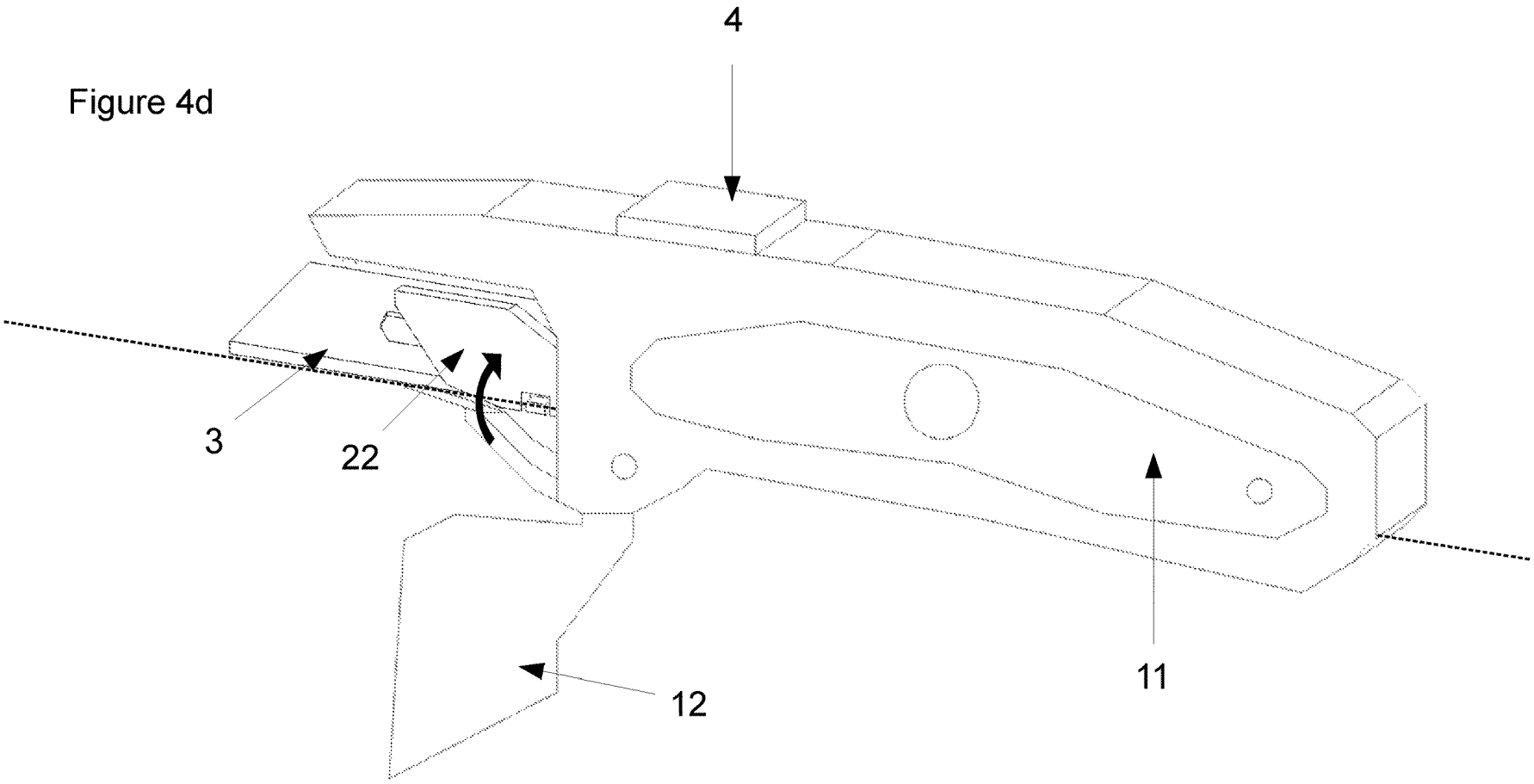
Figure 4E:
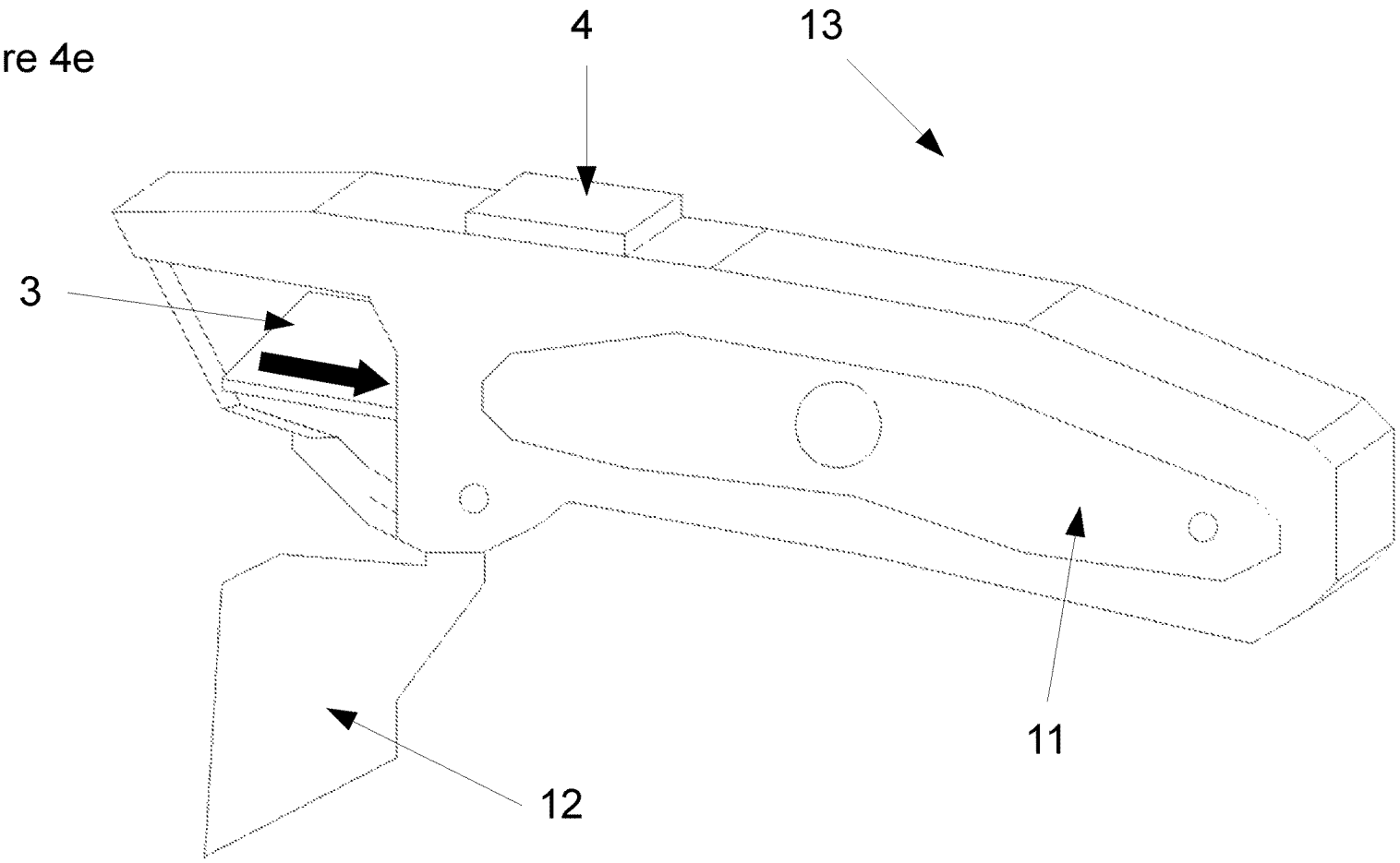

FIGS. 4*a-e* show the blade replacement procedure as foreseen. The first step involves opening the housing 1 by pivoting the lower front part 12 downwards (FIG. 4*a*). Subsequently the blade 3 and blade slide 2 can be slid to the front position by operating the slider 4 (FIG. 4*b*). While maintaining the blade slide 2 in the front position with the slider using one hand, the user can open the blade securing means 22 with the other hand and release the blade 3 (FIG. 4*c*). This temporarily locks the blade slide 2 in the front position and prevents its automatic retraction into the housing 1. The user can then use both hands to remove the old blade 3 and replace it with a new one. As soon as the blade securing means 22 is pivoted back into its vertical position, thus securing the new blade 3 against the blade holder 21 (FIG. 4*d*), the blade slide 2 automatically retracts into the housing 1 (FIG. 4*e*).

The invention claimed is:

1. A cutting hand tool comprising
a housing
a lower front part
connected to the housing at a pivot point pivotable between a closed upper and
an open lower position,
a blade slide
mounted within the housing
slidable between a front extended and
a rear retracted position
with a blade holder and
a blade securing means
connected to said blade slide
pivotable between a vertical closed and
a horizontal open position,
a blade
wherein
pivoting said lower front part of the housing down into the open lower position provides access to said blade securing means if the blade slide is in the front extended position and
pivoting said blade securing means into the horizontal open position provides access to the blade for replacement.

2. The cutting hand tool according to claim 1, wherein said blade slide is biased towards the rear position by a retracting means such as a spring or a magnet.

3. The cutting hand tool according to claim 2, wherein the blade slide is temporarily locked in the front position by pivoting said blade securing means into said lower horizontal position, where the rear end of the blade securing means rest on the housing preventing the retracting means from retracting the blade slide toward the rear position.

4. The cutting hand tool according to claim 1, wherein the blade holder comprises magnets holding the blade in place and preventing it from falling out even when said blade securing means is in said open horizontal position.

* * * * *